US009315281B2

(12) United States Patent
Dissanayake

(10) Patent No.: US 9,315,281 B2
(45) Date of Patent: Apr. 19, 2016

(54) SYSTEM AND METHODS FOR USE IN DISPENSING BIOPHARMACEUTICAL MATERIALS

(71) Applicant: REGENERON PHARMACEUTICALS, INC., Rensselaer, NY (US)

(72) Inventor: Tikiri Jean Dissanayake, Clifton Park, NY (US)

(73) Assignee: REGENERON PHARMACEUTICALS, INC., Rensselaer, NY (US)

( * ) Notice: Subject to any disclaimer, the term of this patent is extended or adjusted under 35 U.S.C. 154(b) by 666 days.

(21) Appl. No.: 13/680,935

(22) Filed: Nov. 19, 2012

(65) Prior Publication Data

US 2014/0137978 A1 May 22, 2014

(51) Int. Cl.
*B65B 3/04* (2006.01)
*B65B 3/00* (2006.01)
(Continued)

(52) U.S. Cl.
CPC . *B65B 3/04* (2013.01); *B65B 3/003* (2013.01); *B65B 3/22* (2013.01); *B65B 3/12* (2013.01)

(58) Field of Classification Search
CPC ..... B65B 3/003; B65B 3/06; B65B 3/04; B65B 3/22; B65B 3/12
USPC ..... 141/2, 18, 83, 85, 236–237, 244, 286, 141/291, 301–302, 349
See application file for complete search history.

(56) References Cited

U.S. PATENT DOCUMENTS 4,750,643 A * 6/1988 Wortrich ..... 222/81
4,754,786 A * 7/1988 Roberts ..... 141/1
(Continued)

FOREIGN PATENT DOCUMENTS

DE 102008049550 A1 4/2010
DE 102011001584 A1 10/2012
(Continued)

OTHER PUBLICATIONS

International Search Report and Written Opinion of corresponding PCT International Application No. PCT/US2012/066366 dated Jul. 31, 2013.
(Continued)

*Primary Examiner* — Timothy L Maust
*Assistant Examiner* — Timothy P Kelly
(74) *Attorney, Agent, or Firm* — Heslin Rothenberg Farley & Mesiti P.C.; Victor A. Cardona, Esq.

(57) ABSTRACT

A pre-sterilized system for dispensing biopharmaceutical materials includes a reservoir for holding biopharmaceutical materials coupled to a filter and distribution manifold connected to a plurality of receiving containers. The manifold includes a plurality of container conduits and a plurality of distribution conduits. The plurality of container conduits is connected to the plurality of receiving containers and supports the plurality of distribution conduits above the plurality of receiving containers to allow flow of the biopharmaceutical materials from the plurality of distribution conduits by gravity into the plurality of receiving containers. The plurality of receiving containers and the manifold are sealed relative to an ambient environment outside the manifold and the plurality of containers to inhibit contamination of the biopharmaceutical materials when the biopharmaceutical materials are inside at least one of the plurality of receiving containers and the manifold.

20 Claims, 8 Drawing Sheets

(51) Int. Cl.
*B65B 3/22* (2006.01)
*B65B 3/12* (2006.01)

(56) References Cited

U.S. PATENT DOCUMENTS

| | | | | |
|---|---|---|---|---|
| 2003/0230521 | A1* | 12/2003 | Schick | 210/110 |
| 2011/0094619 | A1* | 4/2011 | Steel et al. | 141/27 |
| 2012/0222774 | A1* | 9/2012 | Husnu et al. | 141/69 |
| 2013/0126039 | A1 | 5/2013 | Berger et al. | |
| 2013/0220484 | A1* | 8/2013 | De Marco | 141/183 |
| 2014/0027010 | A1* | 1/2014 | Janssens et al. | 141/5 |

FOREIGN PATENT DOCUMENTS

| | | | |
|---|---|---|---|
| WO | 2008038704 | A1 | 4/2008 |
| WO | 2009100428 | A1 | 8/2009 |
| WO | 2011049505 | A1 | 4/2011 |
| WO | 2012092564 | A2 | 7/2012 |

OTHER PUBLICATIONS

SaniSure Drawing, Distributed by Sani-Tech West, Inc., 321 Irving Drive, Oxnard, CA 93030. http://www.sani-techwest.com; at least as early as May 9, 2013.

* cited by examiner

SYSTEM AND METHODS FOR USE IN DISPENSING BIOPHARMACEUTICAL MATERIALS

TECHNICAL FIELD

This invention relates, in general, to biopharmaceutical materials, and more particularly to systems and methods for dispensing biopharmaceutical materials.

BACKGROUND ART

After final manufacturing, biopharmaceutical aqueous materials are often dispensed into containers to be frozen and later thawed and formulated or transported for further packaging into retail sized packaging. The dispensing occurs under sanitary conditions which involves the manual removal of the biopharmaceutical materials from a bulk reservoir (e.g., a 50 liter reservoir) into a plurality of smaller (e.g., 5 liter) containers in a clean environment which requires that workers wear appropriate clothing (e.g., sterile gowning, hoods, gloves, sleeves, etc.) and a positive pressure laminar flow hood (e.g., an ISO 5 class hood) which pushes single-pass filtered air out of the hood in order to prevent any accumulation of particulates or microbes in the environment in which the dispensing of the biopharmaceutical materials is being performed. Actual dispensing of biopharmaceutical materials is performed by removing the caps of the receiving containers within the hood, then pumping the biopharmaceutical material from a bulk container into each open bottle. Upon achieving a certain volume, each bottle is then capped and removed from the hood. A sample may be taken of the dispensed biopharmaceutical materials at some point during the process of removing the biopharmaceutical materials from the bulk reservoir and dispensing into smaller containers by dispensing the material into a separate sampling container. This sample may be tested to ensure the integrity of the biopharmaceutical materials prior to the freezing and/or final packaging thereof in smaller containers or prior to the transfer into retail-sized packaging, for example. Such sampling may be performed at various intervals during the dispensing process resulting in such samples being more or less representative of the product dispensed into the receiving containers. Further, during the filling process, monitoring of the material dispensed in an ambient environment inside the flow hood may be performed to ensure the integrity of the process.

The described dispensing requires that the biopharmaceutical materials be exposed to the uncertainties of open-air dispensing and the uncertainties of manual dispensing by a plurality of individuals required to perform such dispensing. Such uncertainties could lead to contamination of the biopharmaceutical materials and potential danger to a patient having such contaminated materials administered thereto.

Thus, there is a need for systems and methods for dispensing biopharmaceutical materials, which minimize a risk of contamination of the biopharmaceutical materials when it is transferred from a final processing container to plurality of containers for further transport thereof.

SUMMARY OF THE INVENTION

The present invention provides, in a first aspect, a pre-sterilized (via gamma irradiation) system for dispensing biopharmaceutical materials which includes a reservoir for holding biopharmaceutical materials coupled to a distribution manifold connected to a plurality of receiving containers. The manifold includes a plurality of container conduits and a plurality of distribution conduits. The plurality of container conduits is connected to the plurality of receiving containers and supports the plurality of distribution conduits above the plurality of receiving containers to allow flow of the biopharmaceutical materials from the plurality of distribution conduits by gravity into the plurality of receiving containers. The plurality of receiving containers and the manifold are sealed relative to an ambient environment outside the manifold and the plurality of containers to inhibit contamination of the biopharmaceutical materials when the biopharmaceutical materials are inside at least one of the plurality of receiving containers and the manifold.

The present invention provides, in a second aspect, a system for dispensing biopharmaceutical materials which includes a distribution manifold coupled to a bulk reservoir for holding biopharmaceutical materials. The manifold is connected to a plurality of receiving containers to allow fluid communication between the reservoir and the plurality of receiving containers. The manifold includes a plurality of conduits connected to the plurality of receiving containers such that the manifold is self-supporting and located above the plurality of receiving containers. A sampling container is connected to the manifold to allow a flow of the biopharmaceutical materials from the reservoir to be received in the sampling container, thus providing a sample representative of the biopharmaceutical materials. The plurality of receiving containers and the manifold are sealed relative to an ambient environment outside the manifold and the plurality of containers to inhibit contamination of the biopharmaceutical materials when the biopharmaceutical materials are inside at least one of the plurality of receiving containers and the manifold.

The present invention provides, in a third aspect, a method for dispensing biopharmaceutical materials which includes flowing the biopharmaceutical materials from a bulk reservoir storing the biopharmaceutical materials to a distribution manifold coupled to a plurality of receiving container. A plurality of distribution conduits of the manifold is supported by a plurality of container conduits of the manifold connected to the plurality of receiving containers such that the plurality of distribution conduits is located above the plurality of container conduits and the plurality of receiving containers to allow a flow of the biopharmaceutical materials from the plurality of distribution conduits by gravity into the plurality of receiving containers. The plurality of receiving containers and the manifold are sealed relative to an ambient environment outside the manifold and a plurality of receiving containers to inhibit contamination of the biopharmaceutical materials received in at east one of the plurality of receiving containers and the manifold. Once the dispensing operation is completed, each bottle can be isolated and removed from the distribution manifold in a manner that is sealed relative to the ambient environment facilitating allocation and distribution.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be readily understood from the following detailed description of preferred embodiments taken in conjunction with the accompanying drawings in which:

DETAILED DESCRIPTION

Figure 1:
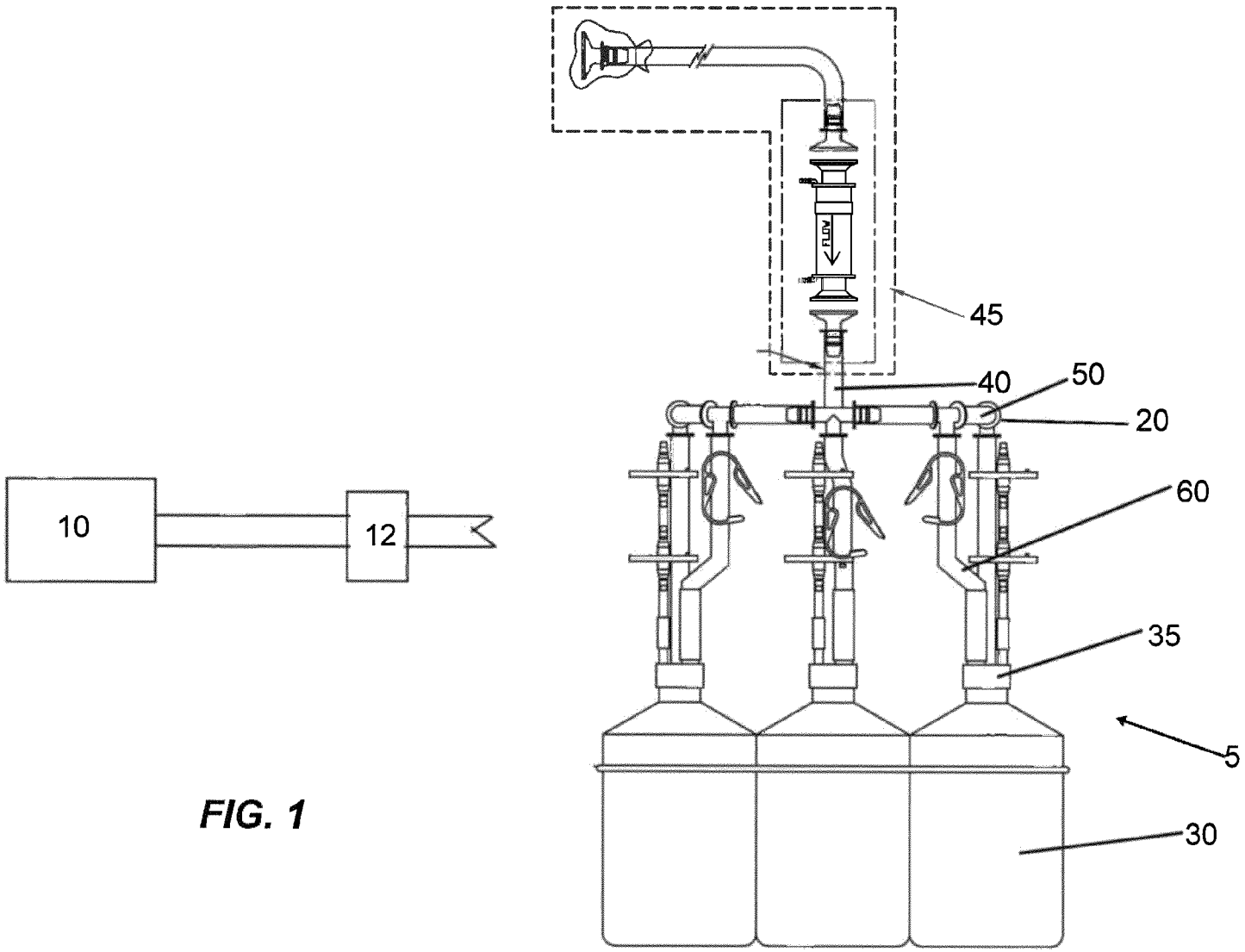
FIG. 1 is a side view of a system for dispensing biopharmaceutical materials in accordance with the present invention.

In accordance with the principles of the present invention, systems and methods for dispensing biopharmaceutical materials are provided.

In an exemplary embodiment depicted in FIGS. 1-6, a system 5 for dispensing biopharmaceutical materials is shown. The system may include a bulk reservoir 10 for holding processed biopharmaceutical materials, a manifold 20 and a plurality of containers 30 connected to the manifold.

Manifold 20 includes an inlet conduit 40, which is coupled to bulk reservoir 10 holding a quantity of processed biopharmaceutical materials (e.g., bulk drug substances or formulated drug substances) desired to be distributed into containers 30. For example, nine containers 30 may be connected to manifold 20 for distribution of the biopharmaceutical materials into the containers as depicted in FIG. 2. A filter assembly 45 (FIGS. 1, 2 and 6) may be coupled to the bulk reservoir (e.g., a 50 liter reservoir) and connected to inlet conduit 40 to inhibit any contaminants from entering containers 30 via manifold 20.

Manifold 20 may include a plurality of distribution conduits 50 which are located above containers 30 and which receive the biopharmaceutical materials from feeder conduits 55 connected to inlet conduit 40, wherein distribution conduits 50 may be located below feeder conduits 55 and above the containers. Distribution conduits 50 may be connected to each other in a loop or otherwise continuous shape (e.g., a modified-square with opposing corners modified to include T-shaped connectors 52 as depicted in FIG. 2) or otherwise such that all of distribution conduits 50 are at about the same height relative to each other and the containers and the distribution conduits may all be in fluid communication with each other. Each of the containers is connected to a container discharge conduit 60 of manifold 20 with container discharge conduit 60 connected to one of distribution conduits 50 via a T-connector or other connector which allows flow throughout the manifold and flow into each container simultaneously.

Manifold 20 connected to the receiving containers may be self-standing such that the distribution conduits 50 are supported by container conduits 60 connected to containers 30. Feeder conduits 55, conduit 40 and filter assembly 45 may also be supported. The various conduits of the manifold connected to the containers are thus configured (e.g., shaped, dimensioned, and having sufficient stiffness) to be connected to one another such that the manifold is self-supporting and remains standing on top of the containers during a dispensing operation such that it is free-draining (e.g., by gravity) in order to maximize the amount of biopharmaceutical materials which are dispensed from the reservoir 10 to receiving containers 30.

Figure 2:
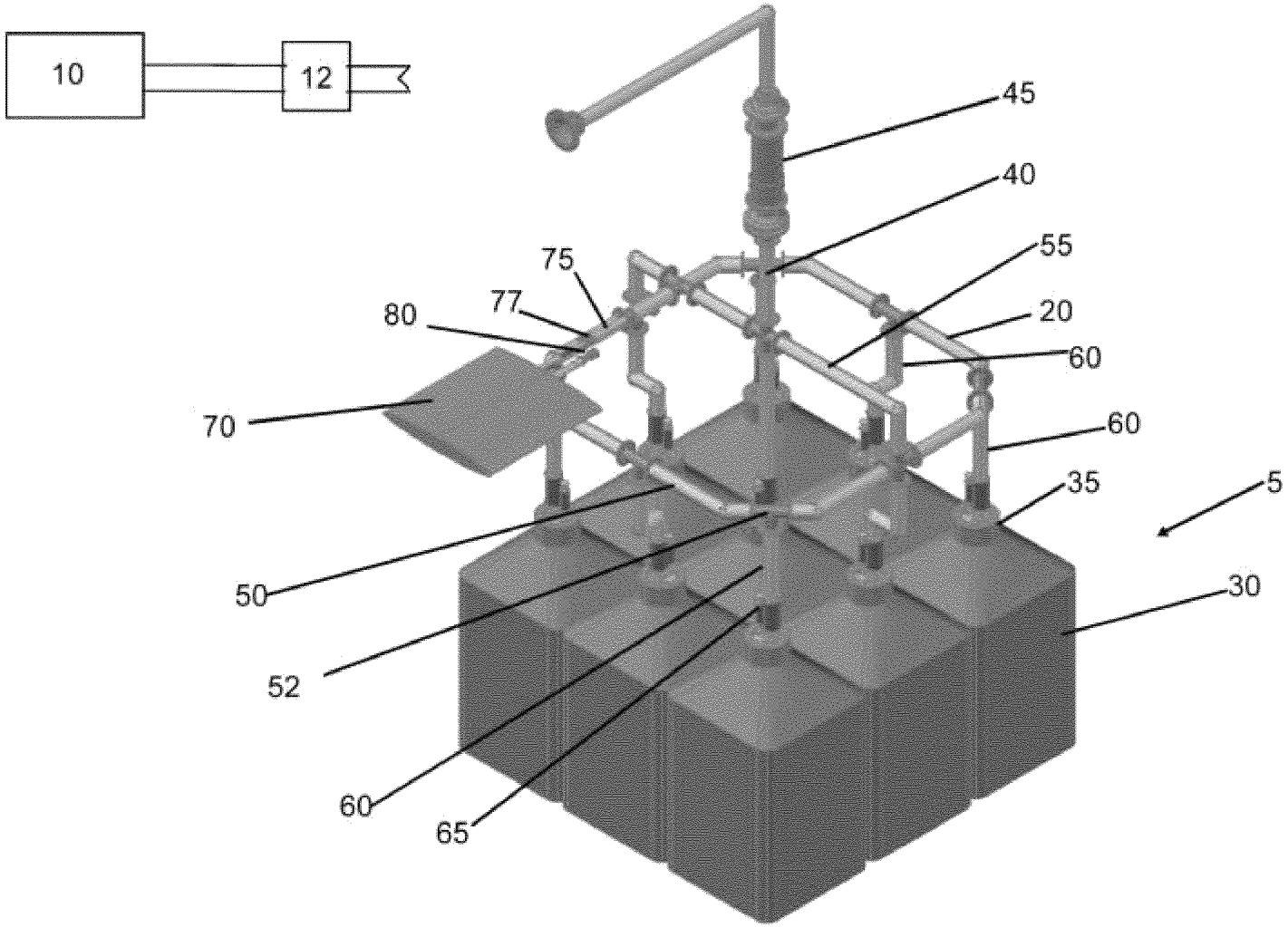
FIG. 2 is a perspective view of the system of FIG. 1 with filters thereof removed for ease of illustration.
Figure 3:
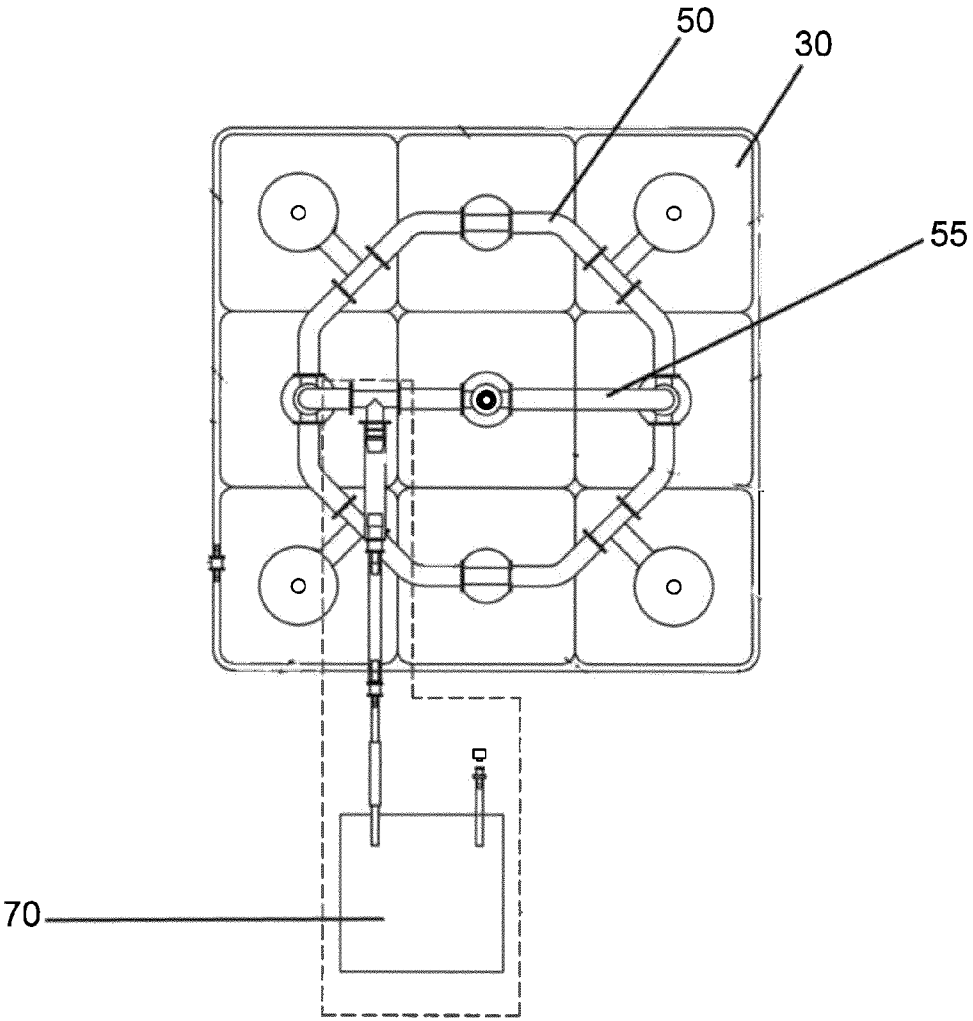
FIG. 3 is a top view of the system of FIG. 1.
Figure 5:
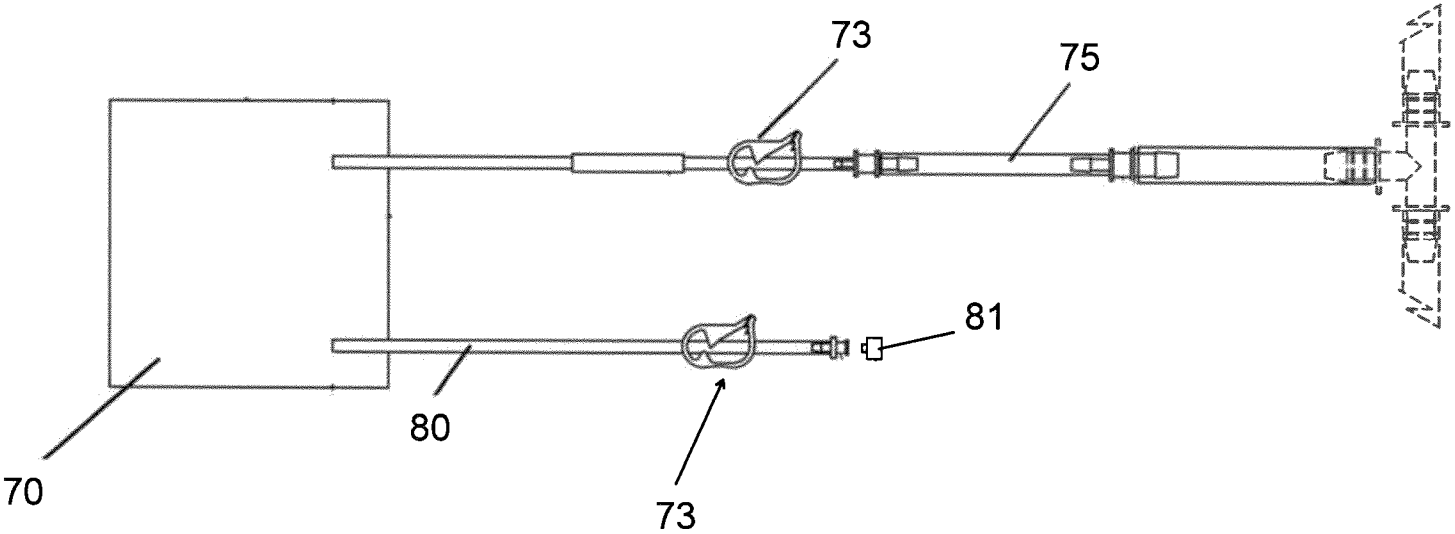
FIG. 5 is a top view of the sampling container of the system of FIG. 1.

A sampling container 70 may be in fluid communication with distribution conduits 50 such that a flow of the biopharmaceutical materials received from reservoir 10 may be received in sampling container 70 as depicted in FIGS. 1, 2 and 5, for example. Once the sample has been taken into container 70, it may be isolated and removed from the feeder conduit 55 in a manner that is sealed relative to the ambient environment, facilitating allocation and distribution. The biopharmaceutical materials held in sampling container 70 may later be analyzed to confirm the quality of the biopharmaceutical materials held in containers 30 by an analysis of the biopharmaceutical materials held in sampling container 70. By analyzing the contents of sampling container an analysis of each of the containers 30 may be avoided. Sampling container 70 may be connected to feeder conduits 55 via a sampling container conduit 75. Alternatively, sampling container 70 could be connected to another portion of manifold 20 via such a sampling container conduit. An outlet 80 of sampling container 70 having a plug 81 may be utilized to allow air to escape from sampling container 70 or to allow sampling of the biopharmaceutical materials held therein after sampling container 70 is disconnected from a portion of sampling container conduit 75. A quick seal connector 77 may be located on conduit 75 and may seal a side of the seal connected with sampling container 70 and a second side of the quick seal, which remains with sampling container conduit 75 when opposite portions of the seal are separated. Such a quick seal may be an aseptic-type seal which allows opposite portions of the seal to be disconnected relative to one another sealing both disconnected portions to inhibit contamination. Also, ratchet clamps 73, or other means of selectively preventing and allowing flow of the biopharmaceutical materials as desired, may be located on sampling container conduit 75 and outlet 80 to allow flow of the biopharmaceutical materials into and/or out of sampling container 70 as desired during a dispensing operation. In another example, the biopharmaceutical materials could flow through the sampling container prior to the biopharmaceutical materials entering the container conduits, the feeder conduit, and/or the containers.

Figure 4:
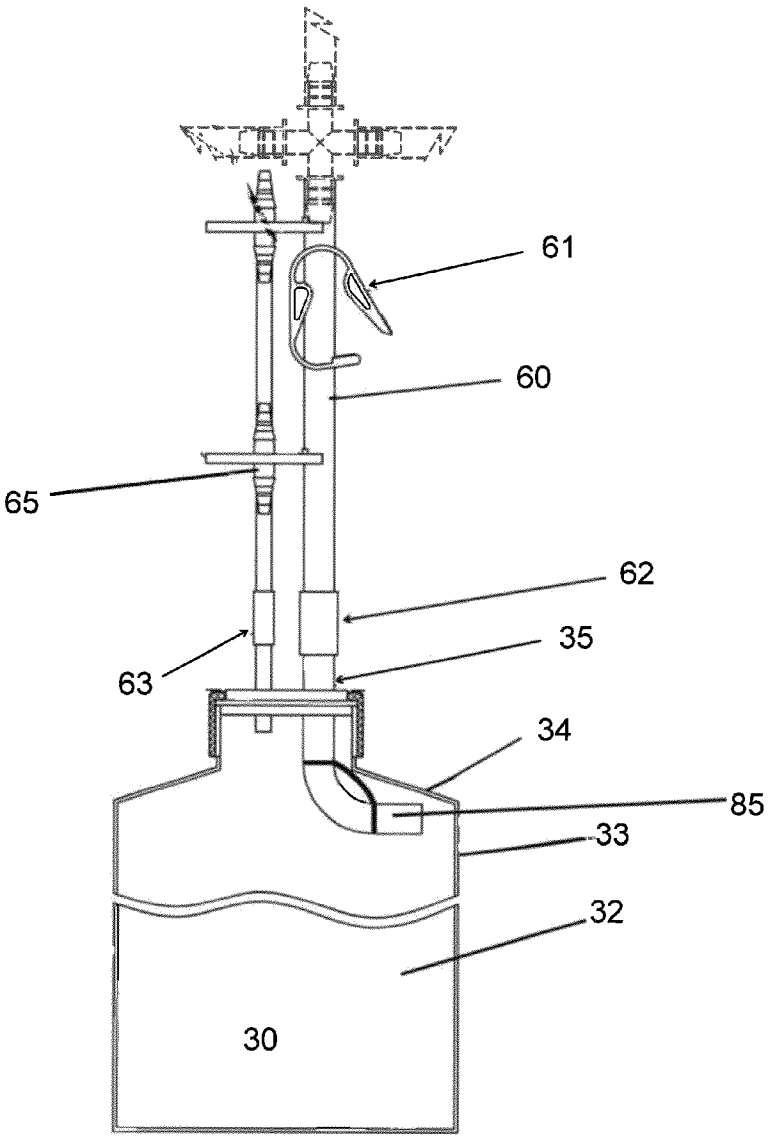
FIG. 4 is a side view of a portion of the system of FIG. 1 depicting a container connected to a portion of a manifold thereof.

Similarly, each of container conduits 60 may include a quick seal 62. Also, each of containers 30 includes a container sterilizing grade hydrophobic filter assembly 65 (e.g., a 0.22 μm porosity filter) which allows air to vacate the containers when biopharmaceutical materials enters therein while inhibiting contamination from entering such containers. Quick seal 62 may be utilized to allow filter assembly 65 to be removed while maintaining an appropriate sealed environment for one of containers 30 attached to the corresponding container conduit. As depicted in FIG. 4, each of container conduits 60 may also include an extension 85 which extends from the container conduit into an interior 32 of container 30 and directs the biopharmaceutical materials against a vertical wall 33 and/or a top surface 34 of container 30 to allow the biopharmaceutical materials to flow down the wall into the container and to inhibit foaming or air entrainment in the biopharmaceutical materials which could lead to degradation (e.g., aggregation) of the biopharmaceutical materials, which is undesirable and may cause biopharmaceutical materials to be less effective or ineffective relative to particular desired pharmaceutical properties.

Each of container conduits 60 may also include a ratchet clamp 61, or other means of releasably preventing flow into or out of container(s) 30 during the dispensing of the biopharmaceutical materials from reservoir 10 into containers 30. Also, each of container conduits 60 may extend from distribution conduits 50 at different angles relative to each other and the containers. For example, as depicted in FIG. 2, the container conduits connecting distribution conduits 50 to the containers directly below filter assembly 45 and on opposite corners of the manifold may extend vertically from distribution conduits 50 toward the containers while the container conduits connecting to the containers in an interior position may be angled or extend vertically, horizontally and vertically to the container. Further, each of containers 30 may include a stopper 35 which allows a container conduit 60 of the container conduits and container filter assembly 65 to extend therethrough while inhibiting any contamination from entering the container.

Figure 6:
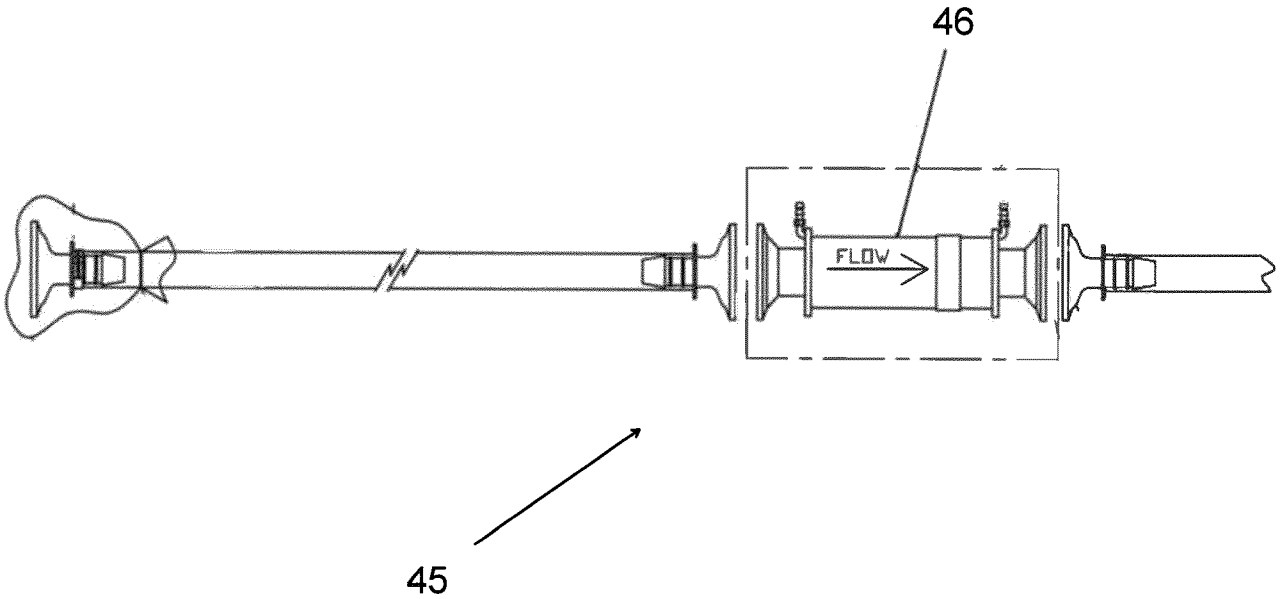
FIG. 6 is a top view of a filter of the system of FIG. 1 illustrated disconnected from the manifold.

As depicted in FIG. 6, filter assembly 45 connected to conduit 40 and coupled to reservoir 10 may include an in-line sterilizing grade hydrophilic filter 46 (e.g., a filter having a porosity≤0.2 μm) which inhibits the passage of contaminants in the direction of manifold 20 through conduit 40. A non-contacting pump 12 (e.g., a peristaltic pump) may be located between reservoir 10 and filter assembly 45 and may pump the biopharmaceutical materials from reservoir 10 toward manifold 20. FIG. 1 depicts reservoir 10 and pump 12 separated from filter assembly 45, but these components could be connected to each other prior to a dispensing operation using a Tri-Clamp-type sanitary connector, for example. In another example, conduit 40 may be coupled to a bulk reservoir (e.g., reservoir 10) without a filter between the reservoir and the conduit. In particular, conduit 40 could be connected to such a reservoir by a sterile connecting device such that a filter utilized to prevent degradation caused by a sanitary connection between the conduit and the reservoir would not be necessary, as would be understood by one of ordinary skill in the art. Specifically, use of a sterile connecter would prevent the introduction of contaminants into conduit 10 and thus system 5.

In one example, a method for dispensing biopharmaceutical materials includes pumping the biopharmaceutical materials from reservoir 10 by pump 12 through filter assembly 45 to manifold 20. The biopharmaceutical materials may enter feeder conduits 55 and flow therefrom into distribution conduits 50 and containers 30. A user may open and close various clamps (e.g., ratchet clamp 61, ratchet clamp 73) on distribution conduits 50 and container conduits 60 to direct the biopharmaceutical materials which may flow by gravity or the force of the pump from feeder conduits 55 into the various containers by the opening and closing of such clamps. The biopharmaceutical materials may flow into the containers through extensions 85 against wall 33 to minimize any potential degradation of the biopharmaceutical materials entering the containers. During the distribution of biopharmaceutical materials into the various containers, one of ratchet clamps 73 may be opened to allow flow of the biopharmaceutical materials into sampling container 70 followed by closing of the ratchet when the container is full. Quick seals on each of container conduits 60 may be sealed and a portion of each seal separated from manifold 20 to allow removal of the containers therefrom and transportation of the containers to an appropriate facility for further processing, e.g., freezing, formulation, or packaging thereof into retail size containers. Similarly, quick seal 77 on sampling container conduit may be sealed and separated.

The conduits described above (e.g., distribution conduits 50, conduit 40, feeder conduits 55, and container conduits 60) may all be silicone tubing or formed of a material which does not degrade in the presence of biopharmaceutical materials or otherwise contaminate such materials. The biopharmaceutical materials could be but would not be limited to, any aqueous cell culture medias, chromatography buffers or therapeutic molecules suspended in specially formulated solutions. The containers (e.g., containers 30) may be 5 liter polycarbonate biotainers or any other container of various sizes formed of a material or having an interior which inhibits degradation or contamination of biopharmaceutical materials held therein. The containers are preferably rigid or semi-rigid such that they are self-supporting and retain their shape when holding biopharmaceutical materials. Such containers could also be connected to one another (e.g., using a propylene connector such that the containers remain abutting one another during the dispensing of the biopharmaceutical materials. Various portions (e.g., distribution conduit portions 55, conduit 40, feeder conduit 55, container conduit 60) of the manifold may also be connected together utilizing connectors (e.g., T-shaped connectors) which may be formed of animal derivative free polypropylene T-shaped connectors or other connectors configured (e.g., shaped and dimensioned) to connect the conduits (e.g., distribution conduit portions 55, conduit 40 feeder conduit 55, container conduit 60) to one another such that the biopharmaceutical materials are sealed therein and to avoid environmental contamination.

Figure 7:
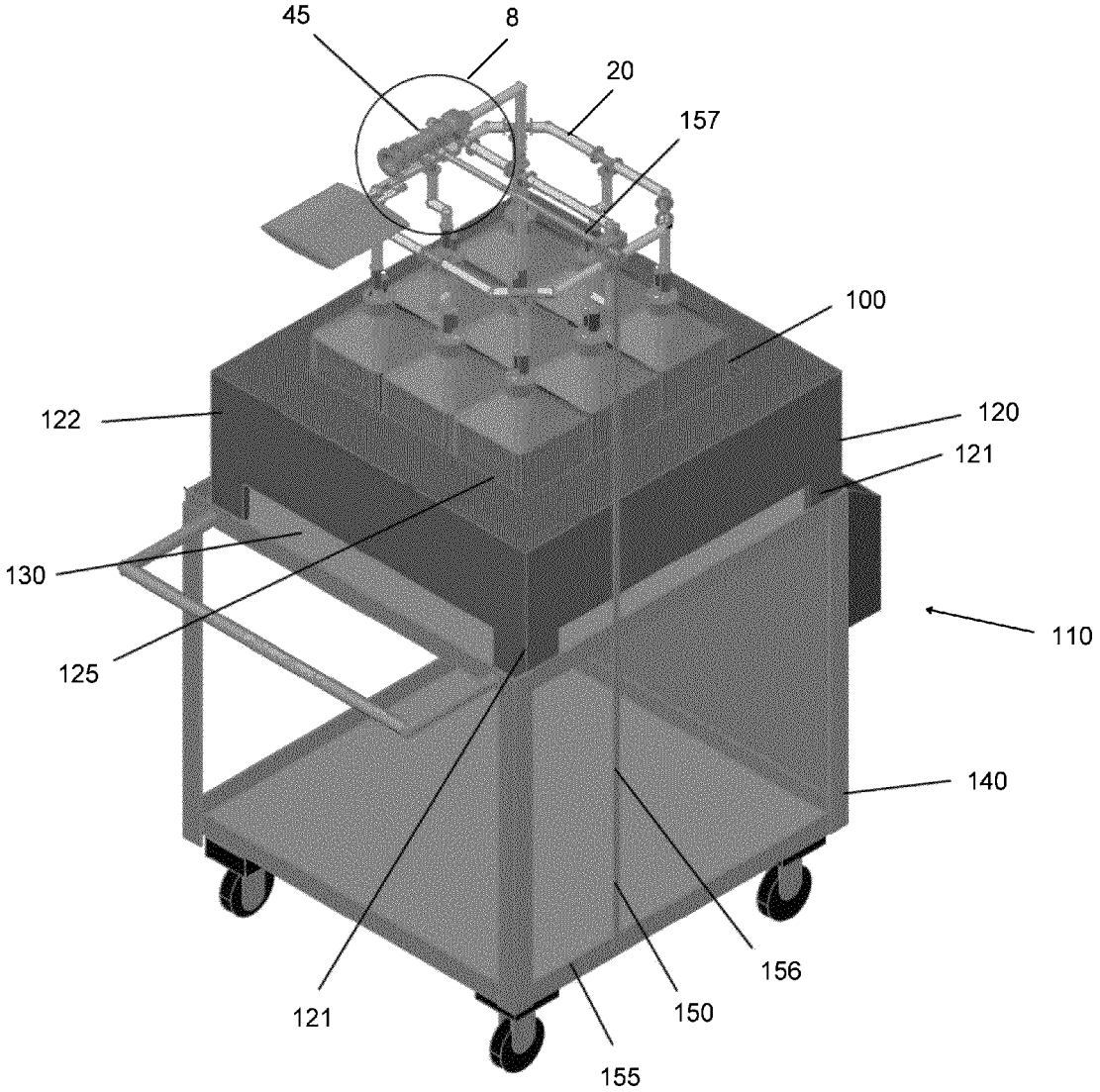
FIG. 7 is a perspective view of the system of FIG. 1 received on a cart for storage and transportation.
Figure 8:
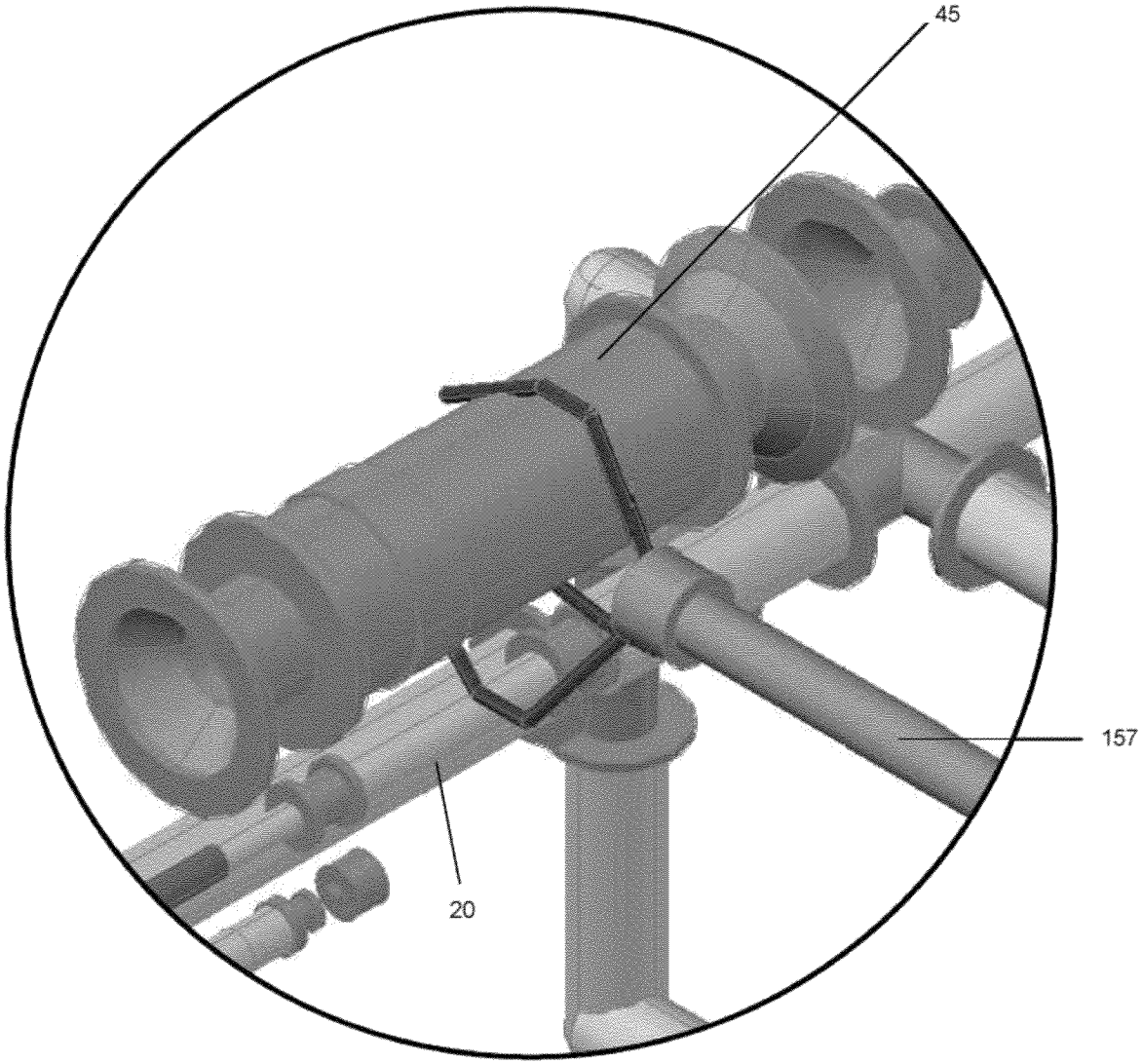
FIG. 8 is an enlarged section of FIG. 7 showing a bracket of the cart holding a filter assembly of the system of FIG. 1.

As depicted in FIG. 7, containers 30 of system 5 may be received in a cavity 100 of a system 110 for transporting and holding system 5. System 110 may include a container holder 120 having an interior surface 125 bounding cavity 100 and forming a protective barrier around containers 30. Container holder 120 may be formed of polypropylene or another material configured to hold containers 30 together and inhibit damage to the containers by any object that could otherwise bump or pierce the containers. Container holder 120 may be received on a top surface 130 of a cart 140 for transporting system 5. Cart 140 may be formed of stainless steel and top surface 130 could be 30 inches by 30 inches and have a height of 39 inches to surface 130. Cart 140 may also include a supporting bracket 150 which extends vertically and horizontally from a bottom shelf 155 of cart 140. Bracket 150 may support and hold filter assembly 45 above manifold 20 as depicted in FIGS. 7 and 8. Bracket 150 may include a vertical component 156 and a horizontal component 157 to facilitate locating bracket 150 above manifold 20.

In another example, a scale (not shown) could be received on top surface 130 and could have containers 30 thereon such that the scale could measure the weight of the containers. As filling of the containers is performed the scale could measure a weight of the containers. Such weight could be used to determine the volume of the biopharmaceutical materials in the containers as the filling of the containers proceeds and whether more biopharmaceutical materials should flow into the containers. Container holder 120 would also surround and protect containers 30 as described above while avoiding contact with the scale or any portion of the scale which would affect the measurement of the weight of the containers received on the scale. As depicted in FIG. 7, container holder 120 could include legs 121 which would allow a main portion 122 to be raised above and not contact a scale received on top surface 130 while still surrounding the containers. In a further example, multiple scales could be received on top surface 130 to allow an individual measurement of the weight of individual containers or the measurement of the weight of groups of containers together. All materials used in system 110 are suitable for clean room usage and can withstand the chemicals utilized for standard cleaning procedures in such a clean room.

While the invention has been depicted and described in detail herein, it will be apparent to those skilled in the relevant art that various modifications additions, substitutions and the like can be made without departing from the spirit of the invention and these are therefore considered to be within the scope of the invention as defined in the following claims.

The invention claimed is:

1. A system for dispensing biopharmaceutical materials, the system comprising:

a plurality of receiving containers;

a distribution manifold connected to the plurality of receiving containers;

a pre-sterilized filter;

a reservoir for holding biopharmaceutical materials connected to the pre-sterilized filter and the distribution manifold, the filter located between said reservoir and said manifold;

said manifold comprising a plurality of container conduits and a plurality of distribution conduits, said plurality of distribution conduits connected to each other to form a continuous shape such that interiors of said plurality of distribution conduits are in fluid communication with each other and are at about a same height relative to each other;

said plurality of container conduits connected to said plurality of receiving containers and supporting said plurality of distribution conduits above said plurality of receiving containers to allow flow of the biopharmaceutical materials from said plurality of distribution conduits by gravity into said plurality of receiving containers; and said plurality of receiving containers and said manifold sealed relative to an ambient environment outside said manifold and said plurality of containers to inhibit contamination of the biopharmaceutical materials when the biopharmaceutical materials are inside at least one of said plurality of receiving containers or said manifold.

2. The system of claim 1 further comprising a sampling container connected to said manifold to allow a flow of the biopharmaceutical materials from said manifold into said sampling container.

3. The system of claim 2 further comprising a sealing connector to allow said sampling container to be sealingly detached from said manifold.

4. The system of claim 2 wherein said sampling container is coupled to said reservoir and said plurality of receiving containers such that the biopharmaceutical materials flows from said reservoir through said sampling container to said plurality of receiving containers.

5. The system of claim 1 further comprising a sampling container in fluid communication with said reservoir and said plurality of receiving containers to allow a flow of the biopharmaceutical materials from said reservoir to said plurality of receiving containers to be received in said sampling container.

6. The system of claim 1 wherein the plurality of container conduits extend into said plurality of receiving containers.

7. The system of claim 6 wherein a first container conduit of the plurality of container conduits comprises an outlet directed against a wall of a first receiving container of the plurality of receiving containers to inhibit foaming of the biopharmaceutical materials when the biopharmaceutical materials flow into the first receiving container.

8. The system of claim 6 wherein a first container conduit of the plurality of container conduits extends into a first container of said plurality of receiving containers, said first container conduit comprising a sealable connector and further comprising an exit port allowing a flow of air from said first container, said exit port comprising a second sealable connector.

9. The system of claim 1 further comprising a plurality of exit ports having filters thereon to allow a flow of air from said plurality of receiving containers when the biopharmaceutical materials flows into the plurality of receiving containers, the filters inhibiting contamination of the biopharmaceutical materials.

10. The system of claim 1 further comprising a pump coupled to said reservoir and said manifold for pumping the biopharmaceutical materials from the reservoir to said manifold.

11. The system of claim 1 wherein said manifold further comprises a plurality of feeder conduits.

12. A system for dispensing biopharmaceutical materials, the system comprising:

a reservoir for holding biopharmaceutical materials;

a distribution manifold coupled to the reservoir;

a plurality of receiving containers;

said manifold connected to the plurality of receiving containers to allow fluid communication between said reservoir and said plurality of receiving containers;

said manifold comprising a plurality of container conduits connected to said plurality of receiving containers such that said manifold is self-supporting and located above said plurality of receiving containers, and a plurality of distribution conduits connected to each other to form a continuous shape such that interiors of said plurality of distribution conduits are in fluid communication with each other and are at about a same height relative to each other, said plurality of distribution conduits are supported by the plurality of container conduits;

a sampling container directly connected to a distribution conduit of the plurality of distribution conduits of said manifold to allow a flow of the biopharmaceutical materials from said reservoir to be received in said sampling container; and said plurality of receiving containers and said manifold sealed relative to an ambient environment outside said manifold and said plurality of containers to inhibit contamination of the biopharmaceutical materials when the biopharmaceutical materials are inside at least one of said plurality of receiving containers and said manifold.

13. A method for dispensing biopharmaceutical materials comprising:

flowing the biopharmaceutical materials from a reservoir storing the biopharmaceutical materials to a distribution manifold coupled to a plurality of receiving containers;

supporting a plurality of distribution conduits of the manifold by a plurality of container conduits of the manifold connected to the plurality of receiving containers such that the plurality of distribution conduits is located above the plurality of container conduits and the plurality of receiving containers to allow a flow of the biopharmaceutical materials from the plurality of distribution conduits by gravity into the plurality of receiving containers;

the plurality of distribution conduits connected to each other to form a continuous shape such that interiors of the plurality of distribution conduits are in fluid communication with each other and are at about a same height relative to each other; and sealing the plurality of receiving containers and the manifold relative to an ambient environment outside the manifold and the plurality of receiving containers to inhibit contamination of the biopharmaceutical materials received in at least one of the plurality of receiving containers and the manifold.

14. The method of claim 13 further comprising:

flowing the biopharmaceutical materials from the manifold to a sampling container connected to the manifold and sealing the sampling container relative to the manifold.

15. The method of claim 13 wherein a first container conduit of the plurality of container conduits comprises an outlet directed against a wall of a first-receiving container of the plurality of receiving containers and flowing the biopharmaceutical materials through the outlet to inhibit aggregation of the biopharmaceutical materials flowing into the first-receiving container.

16. The method of claim 13 further comprising flowing the biopharmaceutical material into the plurality of receiving containers by a force of gravity alone.

17. The method of claim 13 further comprising pumping the biopharmaceutical materials from the reservoir to the manifold using a pump.

18. The system of claim 1 wherein said continuous shape comprises a nonlinear, non-terminating shape.

19. The system of claim 18 wherein said continuous shape comprises a loop.

20. The system of claim 18 wherein said continuous shape comprises a modified square.

* * * * *